US006527824B2

(12) United States Patent
Amick

(10) Patent No.: US 6,527,824 B2
(45) **Date of Patent: *Mar. 4, 2003**

(54) METHOD FOR MANUFACTURING TUNGSTEN-BASED MATERIALS AND ARTICLES BY MECHANICAL ALLOYING

(76) Inventor: Darryl D. Amick, 3227 Countryman Cir., NW., Albany, OR (US) 97321

( * ) Notice: Subject to any disclaimer, the term of this patent is extended or adjusted under 35 U.S.C. 154(b) by 0 days.

This patent is subject to a terminal disclaimer.

(21) Appl. No.: 09/883,798

(22) Filed: Jun. 18, 2001

(65) Prior Publication Data

US 2002/0017163 A1 Feb. 14, 2002

Related U.S. Application Data

(63) Continuation of application No. 09/356,996, filed on Jul. 20, 1999, now Pat. No. 6,248,150.

(51) Int. Cl.[7] ..... B22F 3/00
(52) U.S. Cl. ..... 75/248; 419/32; 419/66
(58) Field of Search ..... 419/32, 66; 75/248

(56) References Cited

U.S. PATENT DOCUMENTS

| | | | | |
|---|---|---|---|---|
| 1,847,617 | A | | 3/1932 | Lowenstein et al. |
| 2,119,876 | A | | 6/1938 | Corson |
| 2,183,359 | A | | 12/1939 | Smithells |
| 2,919,471 | A | | 1/1960 | Hechinger |
| 2,995,090 | A | | 8/1961 | Daubenspeck |
| 3,123,003 | A | | 3/1964 | Lange, Jr. et al. |
| 3,372,021 | A | | 3/1968 | Forbes et al. |
| 3,623,849 | A | | 11/1971 | Benjamin |
| 3,785,801 | A | | 1/1974 | Benjamin |
| 3,852,907 | A | * | 12/1974 | Haught |
| 3,890,145 | A | | 6/1975 | Hivert et al. |
| 3,953,194 | A | | 4/1976 | Hartline, III et al. |
| 4,027,594 | A | | 6/1977 | Olin et al. |
| 4,035,115 | A | | 7/1977 | Hansen |
| 4,035,116 | A | | 7/1977 | O'Brien et al. |
| 4,138,249 | A | | 2/1979 | Rosof |
| 4,274,940 | A | | 6/1981 | Plancqueel et al. |
| 4,338,126 | A | | 7/1982 | Vanderpool et al. |
| 4,383,853 | A | | 5/1983 | Zapffe |
| 4,428,295 | A | | 1/1984 | Urs |
| 4,488,959 | A | | 12/1984 | Agar |
| 4,760,794 | A | | 8/1988 | Allen |
| 4,780,981 | A | | 11/1988 | Hayward et al. |
| 4,784,690 | A | | 11/1988 | Mullendore |
| 4,881,465 | A | | 11/1989 | Hooper et al. |
| 4,897,117 | A | | 1/1990 | Penrice |
| 4,911,625 | A | | 3/1990 | Begg |
| 4,931,252 | A | | 6/1990 | Brunisholz et al. |
| 4,940,404 | A | | 7/1990 | Ammon et al. |
| 4,949,644 | A | | 8/1990 | Brown |
| 4,949,645 | A | | 8/1990 | Hayward et al. |
| 4,958,572 | A | | 9/1990 | Martel |
| 4,960,563 | A | | 10/1990 | Nicolas |
| 4,961,383 | A | | 10/1990 | Fishman et al. |
| 4,990,195 | A | | 2/1991 | Spencer et al. |
| 5,049,184 | A | | 9/1991 | Harner et al. |
| 5,069,869 | A | | 12/1991 | Nicolas et al. |
| 5,088,415 | A | | 2/1992 | Huffman et al. |
| 5,127,332 | A | | 7/1992 | Corzine et al. |
| 5,175,391 | A | | 12/1992 | Walters et al. |
| 5,237,930 | A | | 8/1993 | Belanger et al. |
| 5,264,022 | A | | 11/1993 | Haygarth et al. |
| 5,279,787 | A | | 1/1994 | Oltrogge |
| 5,399,187 | A | | 3/1995 | Mravic |
| 5,527,376 | A | | 6/1996 | Amick |
| 5,535,678 | A | | 7/1996 | Brown |
| 5,713,981 | A | | 2/1998 | Amick |
| 5,719,352 | A | | 2/1998 | Griffin |
| 5,740,516 | A | | 4/1998 | Jiranek, II et al. |
| 5,760,331 | A | | 6/1998 | Lowden et al. |
| 5,786,416 | A | | 7/1998 | Gardner et al. |
| 5,814,759 | A | | 9/1998 | Mravic |
| 5,820,707 | A | | 10/1998 | Amick et al. |
| 5,831,188 | A | | 11/1998 | Amick et al. |
| 5,868,879 | A | | 2/1999 | Amick et al. |
| 5,877,437 | A | | 3/1999 | Oltrogge |
| 5,905,936 | A | | 5/1999 | Fenwick et al. |
| 5,912,399 | A | * | 6/1999 | Yu et al. ..... 75/351 |
| 5,913,256 | A | | 6/1999 | Lowden et al. |
| 5,917,143 | A | | 6/1999 | Stone |
| 5,922,978 | A | | 7/1999 | Carroll |
| 5,950,064 | A | | 9/1999 | Robinson et al. |
| 5,963,776 | A | | 10/1999 | Lowden et al. |

FOREIGN PATENT DOCUMENTS

| | | |
|---|---|---|
| CA | 521944 | 2/1956 |
| FR | 2672619 | 9/1987 |
| GB | 731237 | 12/1953 |
| GB | 2149067 | 6/1985 |
| JP | 52-68800 | 6/1977 |
| JP | 59-6305 | 1/1984 |
| JP | 1-142002 | 6/1989 |

OTHER PUBLICATIONS

English–language abstract of French Patent No. 2,672,619, 1992.

"Steel 3–inch Magnum Loads Our Pick For Waterfowl Hunting," *Gun Tests*, Jan., 1998, pp. 25–27.

J. Carmichel, "Heavy Metal Showdown," *Outdoor Life*, Apr., 1997, pp. 73–78.

"Federal's New Tungsten Pellets," *American Hunter*, Jan., 1997, pp. 18–19, 48–50.

* cited by examiner

*Primary Examiner*—Ngoclan Mai
(74) *Attorney, Agent, or Firm*—Kolisch Hartwell, P.C.

(57) ABSTRACT

A method of producing a high-density article is presented comprising selecting one or more primary tungsten-containing constituents with densities greater than 10.0 g/cc and one or more secondary constituents with densities less than 10.0 g/cc, co-milling the mixture of constituents in a high-energy mill to obtain mechanical alloying effects, then processing the resulting powder product by conventional powder metallurgy to produce an article with bulk density greater than 9.0 g/cc.

37 Claims, No Drawings

METHOD FOR MANUFACTURING TUNGSTEN-BASED MATERIALS AND ARTICLES BY MECHANICAL ALLOYING

RELATED APPLICATION

This application is a continuation of U.S. patent application Ser. No. 09/356,996, which was filed on Jul. 20, 1999, now U.S. Pat. No. 6,248,150 is entitled "Method for Manufacturing Tungsten-based Materials and Articles by Mechanical Alloying," and the complete disclosure of which is hereby incorporated by reference for all purposes.

FIELD OF THE INVENTION

This invention relates to tungsten-containing articles developed as alternatives to those traditionally made of lead and lead alloys.

BACKGROUND OF THE INVENTION

Production of high-density, tungsten-containing materials by conventional powder metallurgical methods is a mature technology which is routinely used to produce a family of materials with relatively high densities. Of particular relevance to the present invention are a variety of materials developed to replace lead and its alloys. Most of these materials are produced by using a series of conventional powder metallurgical processes, for example, (1) selecting graded and controlled metal powders to be combined with graded and controlled tungsten powder to obtain a desired bulk composition, (2) blending the mixture (with or without the addition of lubricants or "binders"), (3) flowing the resulting mixture into a die cavity, (4) applying pressure to the mixture to obtain a mechanically agglomerated part (referred to as a "green compact"), (5) sintering the green compact in a furnace maintained at or near the melting temperature of one or more of the powder constituents to effect metallurgical bonding between adjacent particles, thereby increasing density and strength, and (6) finishing the sintered part by mechanical and/or chemical methods. Conventional tungsten powder metallurgy is at least as old as Colin J. Smithell's U.S. Pat. No. 2,183,359 which describes a family of alloys comprised of tungsten (W), copper (Cu) and nickel (Ni). Tungsten powder metallurgy has matured to include alloys such as W—Co—Cr, W—Ni, W—Fe, W—Ni—Fe et al. which are produced commercially by a large number of companies.

More recently, a variety of materials have been developed for the general purpose of offering alternatives to lead and its alloys. Lead has been outlawed in the U.S., Canada and some European countries for use in waterfowl hunting shot, due to its toxicity. In both civilian and military sectors, there is growing pressure for the outlawing or restriction of lead bullets. Similar pressures against the use of lead are gaining momentum in fishing (lures and sinkers), automotive wheel weights, and even in such household items as curtain weights and children's toys. Perhaps because of concerns pertaining to the health and safety of industrial workers, lead articles of virtually any sort are being viewed as undesirable. These and other social and political pressures have resulted in a spate of recent efforts to find acceptable alternatives to lead.

When one considers available and affordable materials which are denser than, for example, iron or steel, only a limited number of candidate elements come to mind. The choices (bearing in mind that iron and steels have densities of approximately 8 g/cc) include: copper (8.9), nickel (8.9), bismuth (9.8), molybdenum (10.2) and tungsten (19.3). Such metals as U (18.9), Ta (16.6), precious metals and certain "rare earth" elements are deemed too expensive to be economically feasible as lead alternatives. When one calculates the cost-per-density-gain (i.e., the cost/pound of a candidate material, divided by the gain in density over that of iron/steel), it is found that tungsten is the most attractive material available on a commodity basis. Furthermore, ferrotungsten is the most economical form of tungsten, being generally less than half the cost (per pound of contained tungsten) of pure tungsten powder. Many of the methods found in U.S. patents fail to recognize these economic factors. These will be individually addressed later in this section, following presentation of additional factors relevant to tungsten-based lead alternatives (WLA's).

All of the past and present WLA technologies are subject to structural and compositional limitations imposed on the various alloy systems by considerations of thermochemical equilibrium. For example, one may conclude by examining the phase diagram for the Ni—W alloy system that the Ni-rich phase ("alpha") can dissolve only a certain maximum amount of W at a given temperature, and even this amount of W only under conditions of "thermal equilibrium" (i.e., when enough time is allowed at a specified temperature for the system to become stable). This type of limitation is referred to as "limited solid solubility." In conventional WLA technologies, limited solid solubility restricts the amount of W which can be alloyed with another metal during melting or sintering, for example.

Another type of restriction which thermodynamic considerations may identify for certain alloy systems is referred to as "intermetallic compound formation." An example of this may be found in the W—Fe system. If, for example, more tungsten than the amount which can be dissolved in ferritic iron is present in the bulk alloy composition, the "excess" W atoms chemically react with Fe atoms to form intermetallic compounds such as $Fe_7W_6$. Intermetallic compounds are generally harder and more brittle (i.e., less ductile/malleable) than solid solutions of the same metals. This is certainly true of $Fe_7W_6$, as alloys which contain significant amounts of this phase (e.g., "ferrotungsten") are notoriously brittle and therefore difficult to fabricate into useful articles.

In addition to the difficulties associated with limited solid solubility and intermetallic compound formation, conventional WLA's suffer from yet another limitation inherent in conventional powder metallurgy. Because sintering generally involves temperatures above those necessary to cause grain growth, one must accept the fact that the "as-compacted" dimensions of constituent powder particles will be smaller than the dimensions of alloy grains observed in the final product, and that grain sizes will generally be larger at increased sintering times and temperatures. This "grain coarsening" is usually undesirable, as mechanical properties of such products are degraded in accordance with a principle of metallurgy known as the "Hall-Petch" effect.

Yet another problem associated with conventional WLA methods is the potential occurrence of a phenomenon encountered during sintering known as "gravity segregation." If temperatures high enough to cause liquid to form during sintering are employed (referred to as "liquid-phase sintering"), the denser tungsten-rich phase particles will tend to settle out of the mushy mixture, resulting in an inhomogeneous product. In accordance with principles of physics such as Stokes' Law, which describes the settling rates of solid particles in fluids, "gravity segregation" effects will be exacerbated by coarser particles with higher densities.

The present invention offers the potential to significantly reduce problems in producing WLA's which are attributable to limited solid solubility, intermetallic compound formation, coarse grain structure and gravity segregation. Specifically, these improvements are effected by applying a relatively recent technology known as "mechanical alloying" (MA) to tungsten-containing products.

Mechanical alloying is one of several relatively new technologies by which novel materials may be synthesized under conditions described as "far from equilibrium." Such processes are capable of producing metastable phases (i.e., phases not possible under conditions of thermal equilibrium), highly-refined structures and novel composites described as "intimate mechanical mixtures." MA is essentially a highly specialized type of milling process in which material mixtures are subjected to extremely high-energy application rates and repetitive cycles of pressure-welding, deformation, fracturing and rewelding between adjacent particles. These cyclical mechanisms ultimately produce lamellar structures of highly-refined, intimately mixed substances. Localized pressures and temperatures may be instantaneously high enough to cause alloying (by interdiffusion between different constituents) and/or chemical reactions ("mechanochemical processing"). Because such repetitive, instantaneous events are relatively brief, the system is never able to attain thermodynamic equilibrium. An example of the novel materials resulting from "far-from-equilibrium" processing may be seen by referring to the binary phase diagram of the iron-aluminum system. The diagram illustrates that the maximum solid solubility of iron in aluminum is 0.05%. However, MA has been applied to mixtures of Fe and Al to extend the solid solubility range to 9.0% Fe. There are a large number of other examples of extended solid solubility which have been achieved through MA, and additional examples are published every year.

The extremely fine particle or grain sizes resulting from MA make possible the production of novel structures such as "nanocrystals", "quasicrystals" and "amorphous/metal glasses." In nanocrystals, particle dimensions (on the order of nanometers) are so small that the number of metal atoms associated with grain boundaries are equal to, or greater than, the number of geometrically ordered interior atoms. Such materials have very different properties from those of larger-grained, conventional metals and alloys. Similarly, quasicrystals are comprised of small numbers of atoms arranged, for example, as two-dimensional (i.e., flat) particles, while metallic glasses are essentially "amorphous" in structure (i.e., lacking any degree of geometrical atomic arrangement). Each of these material types displays unique properties very unlike those of conventional materials of the same chemical composition, properties of the latter being dependent upon specific planes and directions within individual crystalline grains.

In addition to extended solid solubility and structural refinement, MA has been shown to prevent formation of certain undesirable intermetallic compounds present at equilibrium and to make possible the incorporation of insoluble, non-metallic phases (e.g., oxides) into metals to strengthen metallic grains by a mechanism referred to as "dispersoid strengthening."

Equipment types which have been used to accomplish MA processing include SPEX mills (three-axis "shakers"), attritors ("stirred ball mills"), vibrational mills, and modified conventional ball mills in which greater ball-to-feed ratios and rotational speeds than those of conventional grinding are employed.

In the present invention, MA is presented as being particularly effective in producing WLA's from the combination of a heavy, brittle constituent (e.g., ferrotungsten) and a soft, ductile constituent (e.g., nickel, fin, copper, zinc, bismuth, et al.). MA is further enhanced if the volume fraction of the hard phase is smaller than the volume fraction of the ductile phase, which is exactly the case in WLA compositions (e.g., where densities are similar to the 11.3 g/cc value for lead).

Having presented a variety of factors and considerations which are pertinent to the production of WLA's, the various approaches currently found in U.S. patent literature are individually critiqued:

(1) U.S. Pat. No. 5,913,256 to Lowden et al., Jun. 15, 1999:

The methods presented all involve mixtures or blends of metal powders containing only elemental or equilibrium phases of commonly available particle sizes. Further adding to the cost of graded (i.e., specifically sized and controlled) powders are claims which require costly coating of individual powder particles and addition of "wetting agents" to enhance interparticle bonding. Conventional pressing of the mixtures is employed, but no sintering follows.

(2) U.S. Pat. No. 5,877,437 to Oltrogge, Mar. 2, 1999:

As in (1), methods include mixing metal powders of elemental or equilibrium phases of commonly available particle sizes, followed by conventional powder metallurgical "press-and-sinter" methods. Other claims refer to methods involving molten metal composites and "pastes."

(3) U.S. Pat. No. 5,831,188 to Amick et al., Nov. 3, 1998:

Claims methods of sintering "tungsten-containing powders" to produce an intermetallic compound (an equilibrium phase) of tungsten and iron.

(4) U.S. Pat. No. 5,814,759 to Mravic, Sep. 29, 1998:

Presents methods for preparing mixtures of discrete particles of as-produced ferrotungsten with commonly available sizes of iron powder or polymeric powder, followed by conventional pressing and sintering. As previously mentioned, intermetallic compounds of iron and tungsten (equilibrium phases) are hard and brittle.

(5) U.S. Pat. No. 5,760,331 to Lowden et al., Jun. 2, 1998:

Employs mixtures or blends of metal powders containing only elemental equilibrium phases of commonly available particle sizes.

(6) U.S. Pat. No. 5,786,416 to Gardner et al., Jul. 28, 1998:

One of several patents in which a high-density powder (preferably tungsten) is mixed with one or more polymers.

(7) U.S. Pat. No. 5,719,352 to Griffin, Feb. 17, 1998:

Another metal-polymer method in which tungsten (or molybdenum) particles are mixed with a polymer matrix.

(8) U.S. Pat. No. 5,713,981 to Amick, Feb. 3, 1998:

A melting method in which an iron-tungsten alloy is cast into spherical shot. As in other iron-tungsten methods, brittle intermetallic compounds are present in products.

(9) U.S. Pat. No. 5,527,376 to Amick et al., Jun. 18, 1996:

Similar to (3) in that tungsten and iron powders are sintered to form an alloy of two equilibrium phases, namely, an intermetallic compound and ferritic iron.

(10) U.S. Pat. No. 5,399,187 to Mravic et al., Mar. 21, 1995:

As in (2) and (4), conventional graded metal powders containing elemental or equilibrium phases are pressed-and-sintered in a conventional manner.

(11) U.S. Pat. No. 5,279,787 to Oltrogge, Jan. 18, 1994:

As in (2), commonly available metal powders are used to form a solid-liquid molten slurry or "paste."

(12) U.S. Pat. No. 5,264,022 to Haygarth et al., Nov. 23, 1993:

As in (8), shot is produced from a molten tungsten-iron alloy comprised of equilibrium phases, including intermetallic compounds.

(13) U.S. Pat. No. 4,949,645 to Hayward et al., Aug. 21, 1990:

This is apparently the earliest of the tungsten-polymer patents.

In addition to these 13 reference patents, there are many others which are not considered herein because they contain lead, are not dense enough to be considered as lead substitutes, or do not contain tungsten (and therefore do not qualify as WLA's).

OBJECTS AND ADVANTAGES

The present invention recognizes several problems and limitations of conventional WLA's and proposes mechanical alloying as a means of improving both the cost and quality of powder products and articles produced from them. Specific problems and corresponding solutions possible with MA include:

1) The types of raw materials which are conventionally used in producing WLA's are necessarily of high quality, from such standpoints as chemical purity, controlled particle size distribution, cleanliness of particle surfaces, etc. MA is capable of using relatively inhomogeneous feed materials of loosely specified particle size, due to the super-refinement associated with high-energy milling. For example, ferrotungsten may be used as feed material, in spite of the fact that it is a crude commodity which commonly contains non-metallic slag inclusions. During MA, such brittle particles will become refined and uniformly distributed as dispersoids throughout the final product, thereby reducing detrimental effects associated with larger slag inclusions.
2) Limited solid solubilities between W and other metals inherently limit the densities of ductile alloys possible to make under equilibrium conditions. MA is capable of extending solubility ranges and, in some cases, making ductile W alloys from metals conventionally viewed as being totally insoluble in W.
3) The problem of "gravity segregation", due to the extremely high density of W, is ameliorated by the super-refinement of product particle sizes by MA.
4) The formation of brittle intermetallic compounds is discouraged by the metastable conditions associated with MA
5) Because of the extremely fine structures resulting from MA, smaller grain sizes and superior mechanical properties are possible in a variety of products.
6) Whereas the types of material phases (e.g., solid solutions, compounds, et al.) are limited in conventional WLA processing to those dictated by the appropriate phase diagrams, novel microstructures and metastable phases are possible with MA, thereby expanding the range of material types and properties possible.
7) MA, by virtue of its ability to produce "intimate mechanical mixtures", may make it possible to incorporate metals, compounds and other substances into tungsten-based alloys to produce novel types of composites. For example, it appears to be impractical (by conventional metallurgy) to alloy the heavy metal bismuth with tungsten because of the extreme differences in melting points of the two metals, total insolubility in the solid state and the inherently weak and frangible nature of bismuth. These factors may be inconsequential when MA is employed to produce intimate mechanical mixtures.

Another set of objectives of the present invention is associated with relatively high-density articles produced from mechanically alloyed powder products. Tungsten is generally used in applications in which its high density (19.3 g/cm$^3$) and/or high-temperature strength are required. Applications in which high density is the main requirement are particularly addressed by the present invention because of the fact that chemical purity and many mechanical and physical properties are not critical in many of these applications. This is mentioned because the main difficulties encountered in MA are slight contamination of product by wear of the grinding balls and mill interior surfaces, and difficulty in eliminating porosity in compacted particles. Accordingly, the following objectives address articles in which bulk density is the primary requirement, rather than mechanical properties:

1) production of both frangible and non-frangible bullets, shot and other projectiles from MA powders containing tungsten.
2) production of fishing lures and sinkers from MA powders containing W.
3) production of heavy inserts and counterweights from MA powders containing W.
4) production of wheels, including flywheels and other rotating parts from MA powders containing W.
5) production of automotive wheel weights from MA powders containing W.
6) production of stabilizers and ballast weights used, for example, in aircraft, from MA powders containing W.

DRAWING FIGURES

None

SUMMARY

A method based upon the application of mechanical alloying which is useful in the production of a variety of tungsten-containing powders and articles is presented.

DESCRIPTION

In preparation for mechanical alloying, two or more granular substances are selected, at least one of which contains tungsten and has a density of greater than 10.0 g/cc and at least one of which is a substance of less than 10.0 g/cc density.

The mixture of said granular substances is placed in a high-energy milling machine such as an attritor, shaking mill, vibrating mill or modified (i.e., high ball-to-feed ratio and/or high rotational speed) conventional ball mill. During the milling operation, particles are repeatedly welded together, deformed, is fractured and rewelded to produce progressively finer product potentially containing a rich variety of phases including metastable (i.e., non-equilibrium) solid solutions with extended solubility ("super-saturated solid solutions"), metastable metallic compounds and super-refined structures such as nanocrystals, quasicrystals, amorphous phases and intimate mechanical mixtures. It is possible for tungsten-containing WLA's to be benefited by one or more of these phenomena, even when ungraded or impure feed materials are used.

Mechanically alloyed, tungsten-containing powder products may be further consolidated into useful articles by a variety of processes used in conventional powder metallurgy including such processes as agglomeration, mixing/blending (with or without binder or lubricant additions), compaction, debinding, sintering and finishing (mechanical and/or chemical). In processing MA powders, the extremely fine particle sizes normally produced must be borne in mind in selecting appropriate processing parameters and controls.

In one embodiment of the present invention, special mixtures of MA powders and other conventional powders or granules may be prepared before initiating consolidation. An interesting example of an application in which such combinations of MA and conventional particulates may be useful is found in the production of frangible bullets. In order to gain the desired behavior, namely, the ability of a bullet to dissipate energy by fracture into small, non-lethal fragments upon impact with a hard surface, a blend of MA powders and roughly spherical particles of a larger conventional material may be ideal. In essence, the fine, tungsten-containing MA powder would act as a binder or matrix between the larger particles of conventional material. In each such application, optimum MA-to-conventional mixture ratios would be developed to enhance properties and cost.

Another embodiment of the present invention is its potential for improving properties and costs of WLA articles in which low-cost, albeit ungraded and impure (slag-containing) ferrotungsten may be used as feed material to an MA operation. For example, softer metals such as aluminum, zinc, tin and nickel may be mechanically alloyed with ferrotungsten to produce a highly refined metal-matrix-composite (MMC) in which dispersoids (slag, intermetallic compounds et al.) of sub-micron size are uniformly distributed throughout a relatively ductile matrix phase. The matrix phase may itself have extended solid solubility and other novel properties induced by MA mechanisms.

EXAMPLE

A mixture of 65 g of ungraded (−100 mesh) ferrotungsten (76% W by weight) and 35 g of ungraded (−80 mesh) nickel (99.9% purity) powders were co-milled under high-energy conditions in a SPEX-8000/3-axis shaking mill. After mixing these powders in the mill for 2.0 minutes, a sample was taken for X-ray diffraction (XRD) analysis. (This initial sample and its SRD pattern established the "as-received" condition of the non-mechanically-alloyed powders and the various equilibrium phases present.) Samples of mechanically-alloyed products were taken after 5.0 hours of high-energy milling, and again after 10.0 hours, and submitted for XRD analyses. Table I presents results obtained for the three different samples, which illustrate the progressive phase changes resulting from increasing milling time.

TABLE I

| Observed Peaks: 2-Theta (Phase) | | XRD Results: Peak Intensity (counts per second) Milling Time: 2 minutes | 5 hours | 10 hours |
|---|---|---|---|---|
| 38 | ($Fe_7W_6$) | 85 | 0 | 0 |
| 40.7 | (W) | +130 | +130 | +130 |
| 43.5 | ($Fe_7W_6$) | 91 | 68 | 57 |
| 44.2 | (Ni) | +130 | 0 | 0 |
| 50.8 | ($Fe_7W_6$) | 51 | 35 | 14 |

TABLE I-continued

| Observed Peaks: 2-Theta (Phase) | | XRD Results: Peak Intensity (counts per second) Milling Time: 2 minutes | 5 hours | 10 hours |
|---|---|---|---|---|
| 52 | (Ni) | 77.5 | 0 | 0 |
| 58.4 | (W) | 99 | 39 | 18 |
| 73.3 | (W) | 115 | 64 | 43 |
| 76.2 | (Ni) | 62 | 0 | 0 |

The XRD analyst's observations and conclusions, based on these data, are quoted:

"1. The starting compound contained a considerable amount of W in the elemental or solid solution form.

2. Ni peaks completely disappear, possibly due to the introduction of the element into the Fe—W compound.

3. During milling, some of the peaks corresponding to $Fe_7W_6$ disappear. This could be due to a phase transformation either due to a change in structure induced by milling, addition of Ni by milling, or by both."

This example illustrates the significant modifications to equilibrium phase structures which may be achieved by mechanical alloying mechanisms. Products, as in this example, are often altogether novel substances in comparison to those produced by conventional powder metallurgy.

CONCLUSION, RAMIFICATIONS, AND SCOPE

Accordingly, the reader will observe that the benefits of mechanical alloying may be beneficially applied to a wide variety of tungsten-containing, lead-alternative (WLA) materials. Because traditional consumer articles made of lead have been relatively inexpensive, any viable alternative must be affordable to the general public in order to find acceptance. The ability of MA to tolerate relatively coarse, ungraded, impure input materials (including recycled scrap, ferrotungsten, et al.) offers significant potential cost advantages for such articles as wheel weights, fishing weights, machinery weights, curtain weights, shotgun shot (both for hunting and target shooting) and a variety of different bullet types for civilian, law-enforcement and military use.

Furthermore, the present invention has the additional advantages over other WLA methods in that:

MA powders can be blended with conventional powders to produce products with novel properties such as those desired for non-ricocheting, frangible bullets.

MA can be used to produce novel materials and structures not possible with conventional WLA processes (in which only equilibrium phases are produced).

Another economic advantage of MA is that, unlike most new technologies, existing conventional powder consolidation processes and equipment may be used for mechanically alloyed powders, reducing the amount of additional capital equipment required.

Thus, the scope of the invention should be determined by the appended claims and their legal equivalents, rather than by the examples given.

I claim:

1. A method for producing a high-density article with a bulk density greater than 9.0 grams per cubic centimeter, comprising:

selecting one or more primary tungsten-containing constituents with densities greater than 10.0 grams per cubic centimeter and one or more secondary constituents with densities less than 10.0 grams per cubic centimeter;

co-milling the mixture of constituents in a high-energy mill to obtain mechanical alloying effects and produce mechanically alloyed powders having a bulk density greater than 9.0 grams per cubic centimeter; and blending a mixture of the mechanically alloyed powders with powders that have not been mechanically alloyed, followed by consolidation by conventional powder metallurgy.

2. An article produced in accordance with claim 1.

3. The method of claim 1, wherein the one or more primary tungsten-containing constituents include at least one of tungsten, ferrotungsten, tungsten carbide and alloys containing tungsten.

4. The method of claim 1, wherein the one or more secondary constituents include at least one of aluminum, zinc, tin, nickel, copper, iron, bismuth and alloys thereof.

5. The method of claim 1, wherein the step of consolidating includes forming a firearms projectile from the mixture.

6. A firearms projectile constructed according to the method of claim 5.

7. The firearms projectile of claim 6, wherein the firearms projectile is a frangible bullet.

8. The firearms projectile of claim 6, wherein the firearms projectile is a non-frangible bullet.

9. The firearms projectile of claim 6, wherein the firearms projectile is shotgun shot.

10. The method of claim 1, wherein the step of consolidating includes forming a fishing article from the mixture.

11. A fishing article constructed according to the method of claim 10.

12. The fishing article of claim 11, wherein the article is a fishing lure.

13. The fishing article of claim 11, wherein the article is a fishing sinker.

14. The method of claim 1, wherein the step of consolidating includes forming a weight from the mixture.

15. A weight constructed according to the method of claim 14.

16. The method of claim 1, wherein the step of consolidating includes forming a wheel from the mixture.

17. A wheel constructed according to the method of claim 16.

18. The method of claim 1, wherein the powders that have not been mechanically alloyed have a larger average particle size than the mechanically alloyed powders.

19. The method of claim 1, wherein the mechanically alloyed powders include at least one metastable phase not present in mixtures of the one or more primary tungsten-containing constituents and the one or more secondary constituents that have not been mechanically alloyed.

20. The method of claim 1, wherein at least one of the one or more secondary constituents is conventionally no more than slightly soluble in the one or more tungsten-containing constituents.

21. A method for producing a high-density article with a bulk density greater than 9.0 grams per cubic centimeter, the method comprising:

selecting one or more primary tungsten-containing constituents with densities greater than 10.0 grams per cubic centimeter and one or more secondary constituents with densities less than 9.0 grams per cubic centimeter, wherein the one or more primary tungsten-containing constituents include ferrotungsten;

co-milling the mixture of constituents in a high-energy mill to produce a resultant powder exhibiting mechanical alloying effects; and processing the resultant powder to produce a firearms projectile with a bulk density greater than 9.0 grams per cubic centimeter.

22. A firearms projectile produced according to the method of claim 21.

23. The method of claim 21, wherein the firearms projectile is a frangible bullet.

24. The method of claim 21, wherein the firearms projectile is a non-frangible bullet.

25. The method of claim 21, wherein the firearms projectile is shotgun shot.

26. The method of claim 21, wherein the one or more primary tungsten-containing constituents further include at least one of tungsten, tungsten carbide and alloys containing tungsten.

27. The method of claim 21, wherein the one or more secondary constituents include at least one of aluminum, zinc, tin, nickel, copper, iron, bismuth and alloys thereof.

28. The method of claim 27, wherein the one or more primary tungsten-containing constituents further include, in addition to ferrotungsten, at least one of tungsten, tungsten carbide and other alloys containing tungsten.

29. The method of claim 27, wherein the one or more secondary constituents includes tin.

30. A method for producing a high-density article with a bulk density greater than 9.0 grams per cubic centimeter, the method comprising:

selecting one or more primary tungsten-containing constituents with densities greater than 10.0 grams per cubic centimeter and one or more secondary constituents with densities less than 9.0 grams per cubic centimeter, wherein the one or more secondary constituents includes tin;

co-milling the mixture of constituents in a high-energy mill to produce a resultant powder exhibiting mechanical alloying effects; and processing the resultant powder to produce a firearms projectile with a bulk density greater than 9.0 grams per cubic centimeter.

31. A firearms projectile produced according to the method of claim 30.

32. The method of claim 30, wherein the firearms projectile is a frangible bullet.

33. The method of claim 30, wherein the firearms projectile is a non-frangible bullet.

34. The method of claim 30, wherein the firearms projectile is shotgun shot.

35. The method of claim 30, wherein the one or more primary tungsten-containing constituents include at least one of tungsten, ferrotungsten, tungsten carbide and alloys containing tungsten.

36. The method of claim 30, wherein the one or more secondary constituents further include at least one of aluminum, zinc, nickel, copper, iron, bismuth, alloys thereof, and alloys thereof with tin.

37. The method of claim 36, wherein the one or more primary tungsten-containing constituents include at least one of tungsten, ferrotungsten, tungsten carbide and alloys containing tungsten.

* * * * *